US005803435A

United States Patent [19]

Hsu

[11] Patent Number: 5,803,435

[45] Date of Patent: Sep. 8, 1998

[54] STAPLE REMOVER

[76] Inventor: Nick Hsu, 17th Fl.-3, No. 424, Chungming Rd., Taichung, Taiwan

[21] Appl. No.: 743,203

[22] Filed: Nov. 5, 1996

[51] Int. Cl.[6] ..... B25C 11/00

[52] U.S. Cl. ..... 254/28

[58] Field of Search ..... 254/28; 81/420, 81/421, 422

[56] References Cited

U.S. PATENT DOCUMENTS 2,679,775 6/1954 Fleming ..... 81/420

4,299,146 11/1981 Phelps ..... 81/420

5,494,260 2/1996 Huang ..... 254/28

*Primary Examiner*—Robert C. Watson

*Attorney, Agent, or Firm*—Staas & Halsey

[57] ABSTRACT

A staple remover includes a first arm and a second arm which is pivotally connected to the first arm by a first pin with a spring disposed between the first arm and the second arm, the first arm having a first claw member disposed thereto and the second arm having a second claw member disposed thereto wherein the first/second claw member is disposed transversely to the first/second arm such that the staple remover is put on papers attached by a staple when using the staple remover.

5 Claims, 4 Drawing Sheets

STAPLE REMOVER

BACKGROUND OF THE INVENTION

1. Field of the Invention

The present invention relates to a staple remover and more particularly, to an improved staple remover having two arms pivotally connected with each other at one end thereof and each of the two arms having a respective claw member transversely disposed to the other end thereof.

2. Brief Description of the Prior Art

Staple removers are used to remove staples extending through papers. The staple has two legs extending through the papers and being bent backwardly so as to fixedly attach the papers together. In order to take an individual sheet of paper without tearing the paper, a staple remover is used. Two known staple removers which are known to the Applicant are U.S. Pat. No. 3,494,591 to Jack Fairchild Fleming, entitled "Staple Remover" and U.S. Pat. No. 5,494,260 to Jackson Huang, entitled "Staple Remover". Both of the two prior patents show staple removers composed of two arms and each of the arms has a claw member disposed longitudinally thereto such that when a user uses the staple remover, he/she has to hold the staple remover perpendicular to the papers. However, such a way of using the staple remover means that the user's hand holding the staple remover and the staple remover itself will be the main hindrances which obscure the user the operation of the staple remover.

The present invention intends to provide an improved staple remover in which the claw members are disposed transversely to the arms so as to mitigate and/or obviate the above-mentioned problems.

SUMMARY OF THE INVENTION

The present invention provides a staple remover which includes a first arm and a second arm pivotally connected together with a spring biasedly disposed between the first arm and the second arm. The first arm has a first end and a second end which has two first side walls extending from two opposite sides thereof and each of the first side walls has a first hole defined therein.

The second arm has a first end and a second end which has two second side walls extending respectively from two opposite sides thereof and each of the second side walls has a second hole defined therein. The first arm and the second arm are pivotally connected by extending a first pin through the first hole and the second hole such that the first arm has a first inner side which faces a second inner side of the second arm.

A first claw member is disposed to the first inner side of the first end of the first arm and includes two first plates extending perpendicularly from and transversely to the first inner side of the first arm. A second claw member is disposed to the second inner side of the first end of the second arm and includes two second plates extending perpendicularly from and transversely to the second inner side of the second arm such that the staple remover is used by disposing the staple remover parallel to papers and a staple extending through the papers is removed by urging the first and the second claw members toward each other.

It is an object of the present invention to provide a staple remover which has two claw members disposed transversely to the two arms of the staple remover.

Other objects, advantages, and novel features of the invention will become more apparent from the following detailed description when taken in conjunction with the accompanying drawings.

DETAILED DESCRIPTION OF THE PREFERRED EMBODIMENTS

Figure 1:
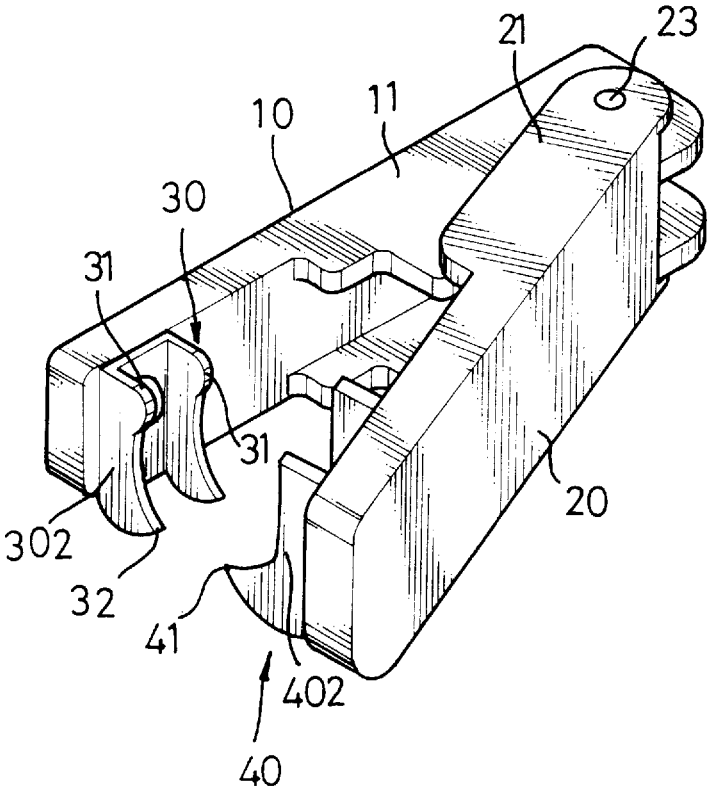
FIG. 1 is a perspective view of a staple remover in accordance with a first embodiment of the present invention.
Figure 2:
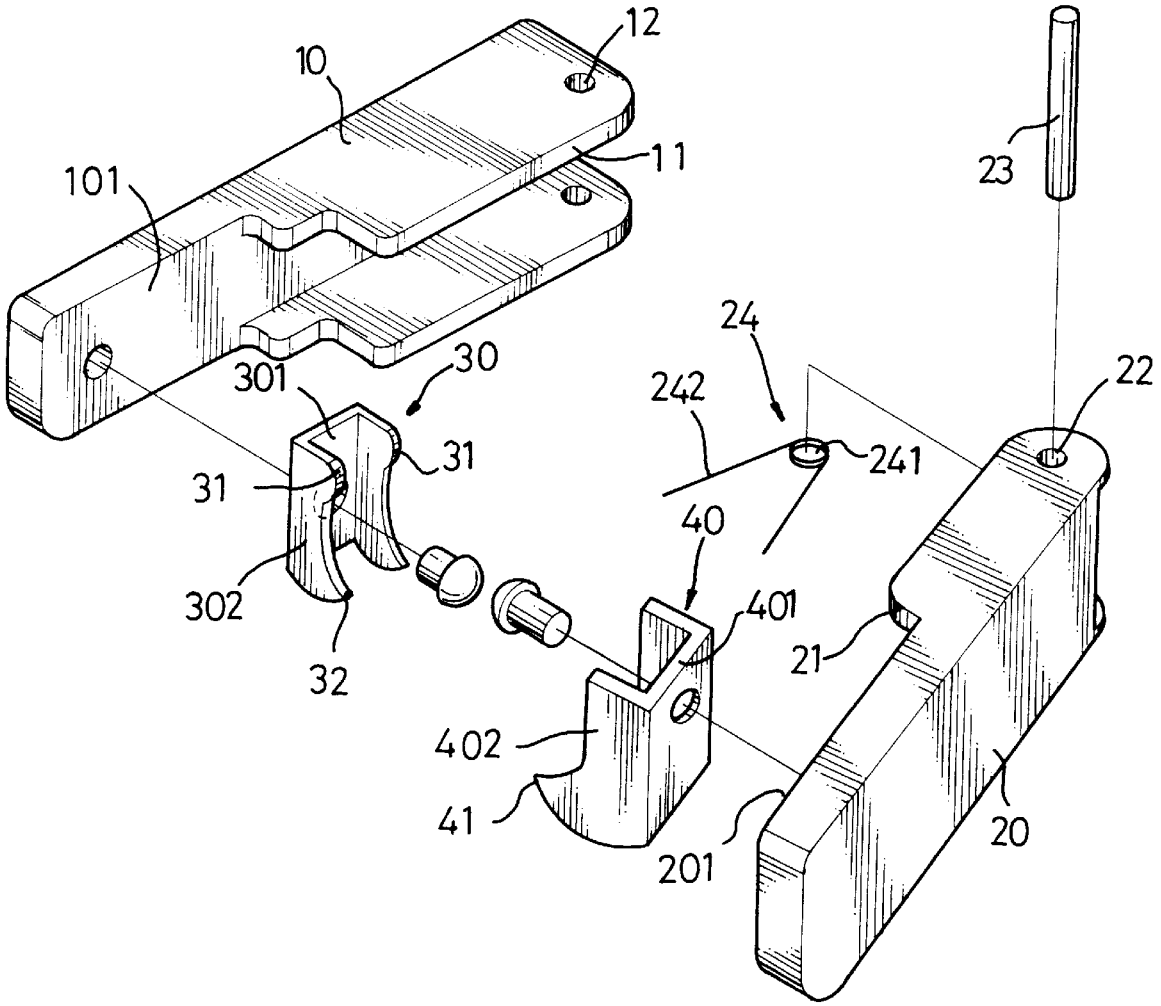
FIG. 2 is an exploded view of the staple remover in accordance with a first embodiment of the present invention.

Referring to the drawings and initially to FIGS. 1 and 2, a staple remover in accordance with the present invention generally includes a first arm 10 and a second arm 20, the first arm 10 having a first end and a second end which has two first side walls 11 extending from two opposite sides thereof and each of the first side walls 11 has a first hole 12 defined therein. The second arm 20 has a first end and a second end which has two second side walls 21 extending from two opposite sides thereof and each of the second side walls 21 has a second hole 22 defined therein. The first arm 10 and the second arm 20 are pivotally connected with each other by a first pin 23 extending through the first hole 12 and the second hole 22 such that the first arm 10 has a first inner side 101 which faces a second inner side 201 of the second arm 20.

A spring 24 has a ring portion 241 and two extending portions 242 respectively extending from the ring portion 241. The ring portion 241 of the spring 24 is mounted to the first pin 23 and the two extending portions 242 contact against the first inner side 101 of the first arm 10 and the second inner side 201 of the second arm 20, respectively.

A first claw member 30 has a bottom 301 and two first plates 302 extending perpendicularly in a same direction therefor, from two opposite sides of the bottom 301. The first claw member 30 is fixedly disposed to the first inner side 101 of the first end of the first arm 10 and a longitudinal axis of the bottom 301 is perpendicular to a longitudinal axis of the first arm 10. A second claw member 40 has a bottom 401 and two second plates 402 extending perpendicularly from two opposite sides of the bottom 401. The second claw member 40 is fixedly disposed to the second inner side 201 of the first end of the second arm 20 and a longitudinal axis of the bottom 40 of the second claw member is perpendicular to a longitudinal axis of the second arm 20.

Each of the first plates 302 of the first claw member 30 has a first end and a second end which has a protrusion 31 extending transversely therefrom and toward the second claw member 40. The first end of each of the first plates 302 of the first claw member 30 has a first hook portion 32 formed transversely thereto and toward the second claw member 40. Each of the second plates 402 of the second claw members 40 has a first end and a second end, the first end of each of the second plates 402 having a second hook portion 41 formed transversely thereto and toward the first hook portion 32 corresponding thereto. Each of the first ends of the first plates 302 is a curved end and each of the first ends of the second plates 402 are respectively a curved end. A distance between the two first plates 302 is less than a distance between the two second plates 402.

Figure 3:
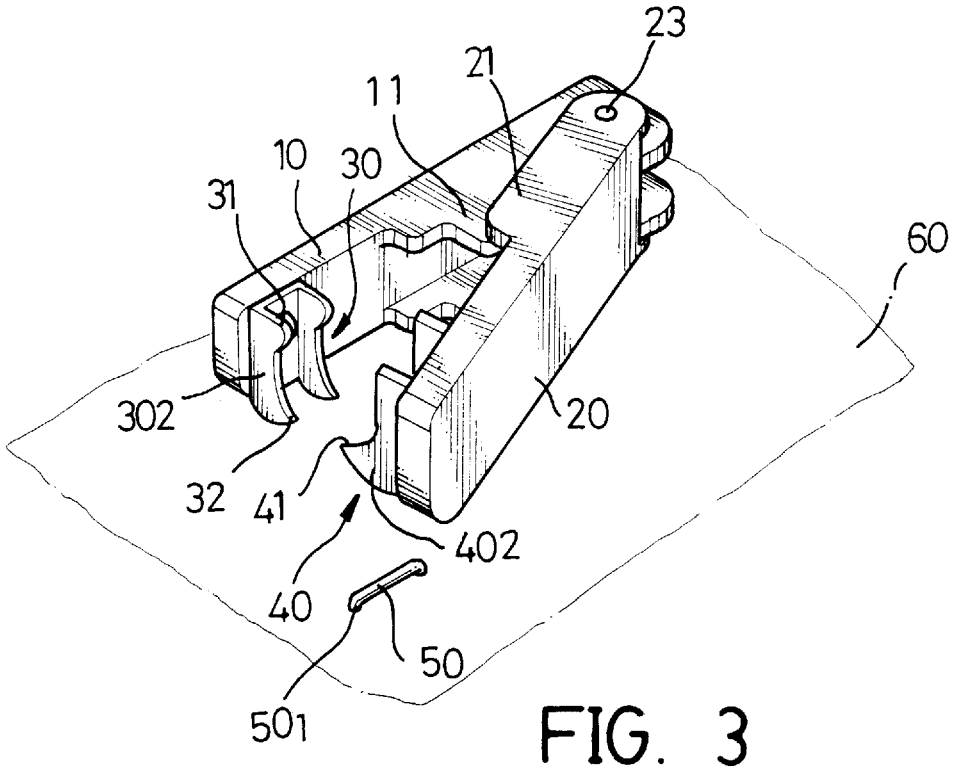
FIG. 3 is a perspective view to show the staple remover about to remove a staple extending through papers.
Figure 4:
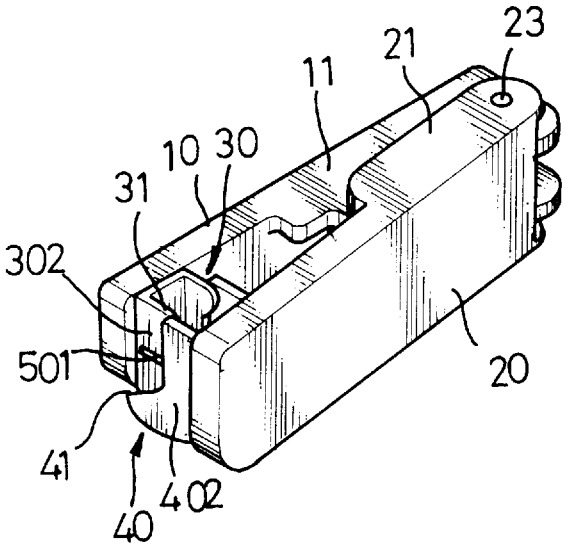
FIG. 4 is a perspective view to show the staple being is removed from the papers and clamped by the staple remover.

Referring now to FIGS. 3 and 4, when using the staple remover in accordance with the present invention, the staple remover is disposed in parallel to a pile of papers 60 attached by a staple 50 extending through the papers 60 and the two first hook portions 32 are inserted between two legs 501 of the staple 50. Then a user (not shown) clamps the first arm 10 and the second arm 20 toward each other such that the two first plates 302 are movably inserted between the two second plates 402 and the staple 50 can be removed from the papers 60. The removed staple 50 is clamped and lifted by the staple remover and is limited by the two protrusions 31 so as to prevent the staple from dropping to the floor. Furthermore, the curved first ends of the first plates 302 and the second plates 402 will protect the papers 60 from being torn by the first plates 302 and the second plates 402.

Accordingly, when using the staple remover of the invention, the user's hand (not shown) is put on the papers 60 and beside the staple 50 such that the user can see the operation of the staple remover clearly.

Figure 5:
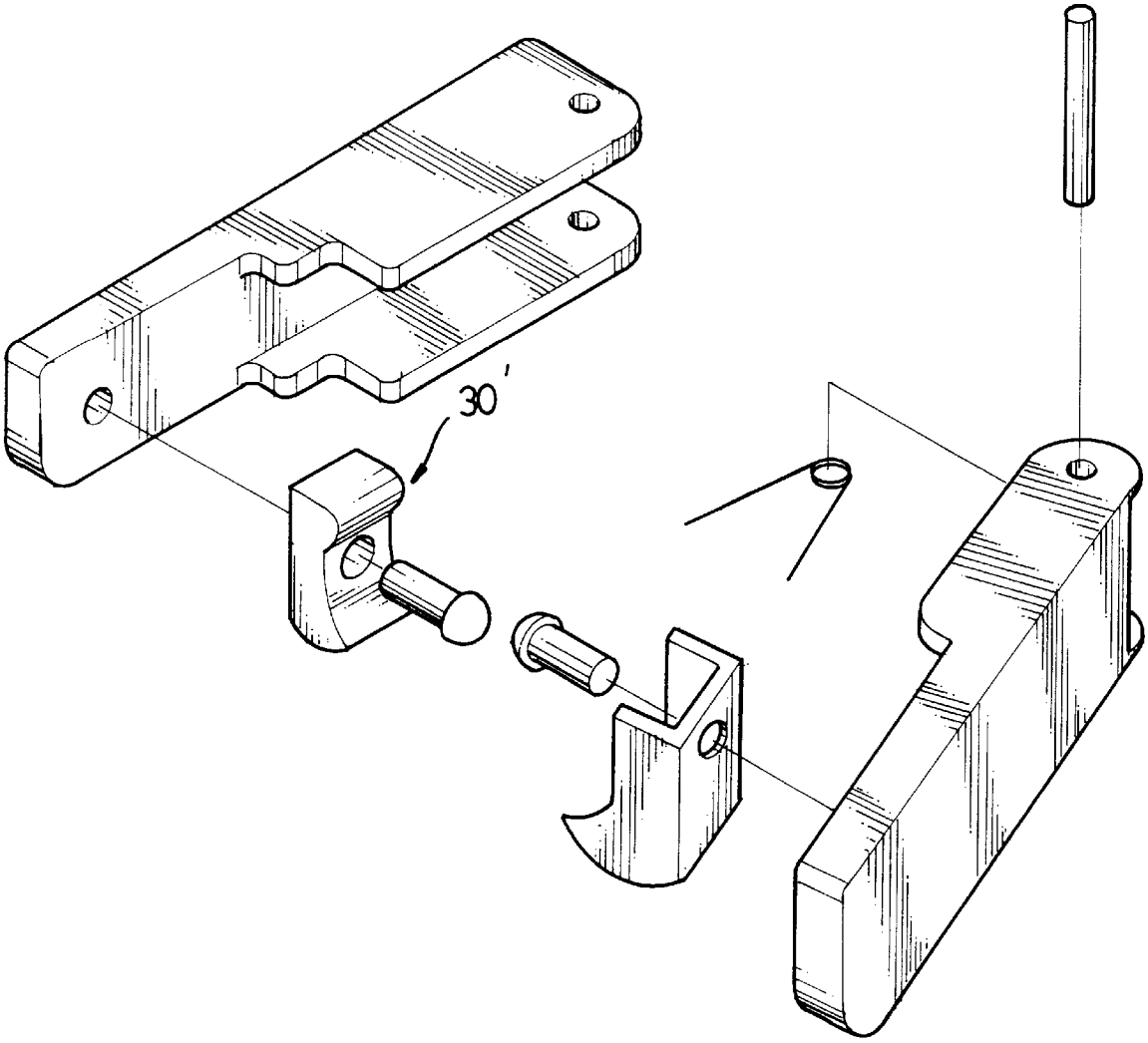
FIG. 5 is an exploded view of a second embodiment of the staple remover in accordance with the present invention.

FIG. 5 shows a second embodiment of the staple remover in which the first claw member 30' can be made of an integral and solid member, that is, the area between the two first plates 302 of the first claw member 30 shown in FIG. 2 is filled to form an integral first claw member 30'.

Although the invention has been explained in relation to its preferred embodiments, it is to be understood that many other possible modifications and variations can be made without departing from the spirit and scope of the invention as hereinafter claimed.

What is claimed is:

1. A staple remover comprising:

a first arm having a first end and a second end, two first side walls extending from two opposite sides of said second end of said first arm and each of said first side walls having a first hole defined therein;

a second arm having a first end and a second end, two second side walls extending from two opposite sides of said second end of said second arm and each of said second side walls having a second hole defined therein, said first arm and said second arm pivotally connected with each other by extending a first pin through said first hole and said second hole such that said first arm has a first inner side which faces a second inner side of said second arm;

a spring having two extending portions, said spring mounted to said first pin and said two extending portions respectively contacting against said first inner side of said first arm and said second inner side of said second arm;

a first claw member disposed to said first inner side of said first end of said first arm, said first claw member including a bottom with two first plates extending perpendicularly from two opposite sides thereof, a longitudinal axis of said bottom of said first claw member being perpendicular to a longitudinal axis of said first arm; and a second claw member disposed to said second inner side of said first end of said second arm, said second claw member including a bottom with two second plates extending perpendicularly from two opposite sides thereof, a longitudinal axis of said bottom of said second claw member being perpendicular to a longitudinal axis of said second arm.

2. The staple remover as claimed in claim 1, wherein each of said first plates of said first claw member has a first end and a second end which has a protrusion extending transversely therefrom toward said second claw member.

3. The staple remover as claimed in claim 1, wherein said first end of each of said first plates of said first claw member has a first hook portion formed transversely thereto and toward said second claw member, each of said second plates of said second claw members has a first end and a second end, said first end of each of said second plates having a second hook portion formed transversely thereto and toward said first hook portion corresponding thereto.

4. The staple remover as claimed in claim 1, wherein each of said first ends of said first plates is a curved end and each of said first ends of said second plates is a curved end.

5. The staple remover as claimed in claim 1, wherein a distance between said two first plates is less than a distance between said two second plates.

* * * * *